US006511287B2

(12) United States Patent
Kim

(10) Patent No.: US 6,511,287 B2
(45) Date of Patent: Jan. 28, 2003

(54) BLOWING FAN ASSEMBLY FOR A WINDOW-TYPE AIR CONDITIONER

(75) Inventor: Sung Chun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/921,709

(22) Filed: Aug. 6, 2001

(65) Prior Publication Data

US 2002/0021963 A1 Feb. 21, 2002

(30) Foreign Application Priority Data

Aug. 17, 2000 (KR) ..... 2000-47395

(51) Int. Cl.[7] ..... F01D 1/02
(52) U.S. Cl. ..... 415/204; 62/262; 417/423.14
(58) Field of Search ..... 415/204, 203, 415/206; 62/262; 417/423.14, 423.15

(56) References Cited

U.S. PATENT DOCUMENTS 3,680,328 A * 8/1972 McCarty ..... 62/262
4,102,148 A * 7/1978 Matthews et al. ..... 62/77
4,633,680 A * 1/1987 Lang et al. ..... 62/263
6,032,479 A * 3/2000 Choi et al. ..... 62/262
6,182,460 B1 * 2/2001 Hernandez et al. ..... 62/262

* cited by examiner

*Primary Examiner*—Edward K. Look
*Assistant Examiner*—James M McAleenan
(74) *Attorney, Agent, or Firm*—Birch, Stewart, Kolasch & Birch, LLP

(57) ABSTRACT

A blowing fan assembly for a window-type air conditioner which includes a scroll case and a turbofan disposed in the scroll case and connected with a driving motor, the turbofan having a hub, a plurality of blades which are located at a predetermined separation from the hub, and a shroud which is attached to distal ends of the plurality of blades in opposition to the hub. A depression is formed at the rear wall of the scroll case in a manner such that the diameter of the depression is greater than an outer diameter of the turbofan, and the turbofan is lop-sidedly positioned in the scroll case in such a way as to adjoin the depression, whereby the air passage which is defined between the shroud of the turbofan and a suction opening of the scroll case, is increased.

4 Claims, 5 Drawing Sheets

BLOWING FAN ASSEMBLY FOR A WINDOW-TYPE AIR CONDITIONER

BACKGROUND OF THE INVENTION

1. Field of the Invention

The present invention relates to a blowing fan assembly, and more particularly, to a blowing fan assembly which is applied to a window-type air conditioner.

2. Description of the Related Art

Generally, as shown in FIG. 1, a window-type air conditioner has a single case 10. In the case 10, there are arranged a compressor 12 for compressing refrigerant, a condenser 14 for condensing the refrigerant which is compressed by the compressor 12, thereby decreasing the temperature of the refrigerant, and an evaporator 16 for performing a heat-exchanging function using the refrigerant which is reduced in terms of its temperature by the condenser 14.

The space which is defined in the case 10 of the window-type air conditioner is divided into an indoor portion and an outdoor portion by a partition panel 18.

The evaporator 16 and a blowing fan assembly 20 for circulating room air through the evaporator 16 are disposed in the indoor portion. The compressor 12, the condenser 14, an axial-flow fan 30 for enabling the condenser 14 to conduct a condensing function using outside air, and the like are disposed in the outdoor part.

Here, the blowing fan assembly 20 possesses, as shown in FIG. 2, a scroll case 22 which defines an air passage and a turbofan 24 which is located inside the scroll case 22. A front surface of the scroll case 22 is defined, as shown in FIGS. 3 and 4, with a suction opening 22*a* which has a bell mouth-shaped contour and through which the room air is sucked into the scroll case 22. Also, the front surface of the scroll case 22 is defined, at a side of the suction opening 22*a*, with a discharge opening 22*b*.

The turbofan 24 is connected to a driving motor 40. The turbofan 24 is composed of a hub 241, a plurality of blades 242 which are located at a predetermined separation from the hub 241, and a shroud 243 which is attached to the distal ends of the plurality of blades 242 and opposite to the hub 241.

By the blowing fan assembly 20, constructed as mentioned above, warm air in the room passes through the evaporator 16 by the rotating action of the turbofan 24 and is thereby cooled. Thereafter, the cooled air is drawn into the scroll case 22 through the suction opening 22*a*. Then, the drawn-in air is compressed by the plurality of blades 242 and discharged from the scroll case 22 through the discharging opening 22*b*. In this way, the temperature of the air in the room is properly adjusted so as to cool the room.

At this time, the cooled air which is discharged out of the scroll case 22, is not immediately re-drawn into the scroll case 22 due to a static pressure increase effect which is induced inside the scroll case 22 by the presence of the shroud 243, but instead, is dispersed over a remote region.

The refrigerant which is raised in its temperature by being brought into contact with the warm air at the evaporator 16, is re-cooled, in the course of passing through the condenser 14, by the outside air which flows into the outdoor portion by the rotating action of the axial-flow fan 30, so as to be continuously circulated.

On the other hand, in the blowing fan assembly for a conventional window-type air conditioner, a sirocco fan (not shown) can be used in place of the turbofan 24. In this regard, because the sirocco fan has a large air-blowing rate, the size of the sirocco fan can be decreased. However, when assuming that the turbofan 24 and the sirocco fan have the same air blowing rate, since the sirocco fan has increased power consumption in comparison with the turbofan 24, the sirocco fan has the disadvantage that its operating efficiency is degraded.

As a consequence, the turbofan 24, which has a higher operating efficiency than the sirocco fan, is frequently used for a blowing fan assembly. Due to the fact that the turbofan 24 occupies an increased volume when compared to the sirocco fan having the same air blowing rate, in order to accomplish an efficient blowing function using the turbofan, a sufficient air blowing passage must be secured in the scroll case 22.

Thus, because the size of an air conditioner to which the turbofan 24 is applied, is larger than that of an air conditioner to which a sirocco fan of the same air blowing rate is applied, the blowing fan assembly including the aforementioned turbofan 24 adversely affects miniaturization of the air conditioner.

Moreover, in a state wherein the scroll case 22 of the blowing fan assembly, to which the turbofan 24 is applied, has the same size as that of the blowing fan assembly to which the sirocco fan is applied, if the rotational velocity of the turbofan 24 is raised so as to accomplish the desired blowing function, a problem is created in that operating noise of the driving motor 40 is increased.

SUMMARY OF THE INVENTION

Accordingly, the present invention has been made in an effort to solve the problems occurring in the related art, and thus an object of the present invention is to provide a blowing fan assembly for a window-type air conditioner, in which a scroll case is configured in such a way as to enlarge the air passage, whereby an efficient blowing function is enabled without experiencing an increase in a volume of the entire blowing fan assembly and without raising the rotational velocity of a turbofan.

In order to achieve the above object, according to one aspect of the present invention, there is provided a blowing fan assembly for a window-type air conditioner, including a scroll case and a turbofan which is disposed in the scroll case and connected with a driving motor. The turbofan has a hub, a plurality of blades which are located at a predetermined separation from the hub and a shroud which is attached to the distal ends of the plurality of blades and positioned opposite to the hub. A depression is formed on the bottom wall of the scroll case in a manner such that the diameter of the depression is larger than the outer diameter of the turbofan, and the turbofan is positioned off-center in the scroll case in such a way as to adjoin the depression, whereby the air passage, which is defined between the shroud of the turbofan and a suction opening of the scroll case, is enlarged.

According to another aspect of the present invention, an auxiliary depression which has a wedge-shaped contour, is formed at a side of the depression on the bottom wall of the scroll case, in a manner such that the auxiliary depression is gradually reduced in a direction remote from the depression so as to allow the flow rate of air discharged out of the turbofan to be increased.

According to still another aspect of the present invention, the depression is formed in a manner such that it has a depth in the range of 10–20% of the width of the scroll case, a diameter in the range of 100–110% of the outer diameter of the turbofan, and a projecting angle of 30–45°.

According to yet another aspect of the present invention, the auxiliary depression having a wedge-shaped contour is formed in a manner such that the distance between an apex thereof and the center of the depression is in the range of 140–160% of the outer diameter of the turbofan.

BRIEF DESCRIPTION OF THE DRAWINGS

The above objects, and other features and advantages of the present invention will become more apparent after a reading of the following detailed description when taken in conjunction with the drawings, wherein.

DETAILED DESCRIPTION OF PREFERRED EMBODIMENTS

Figure 1:
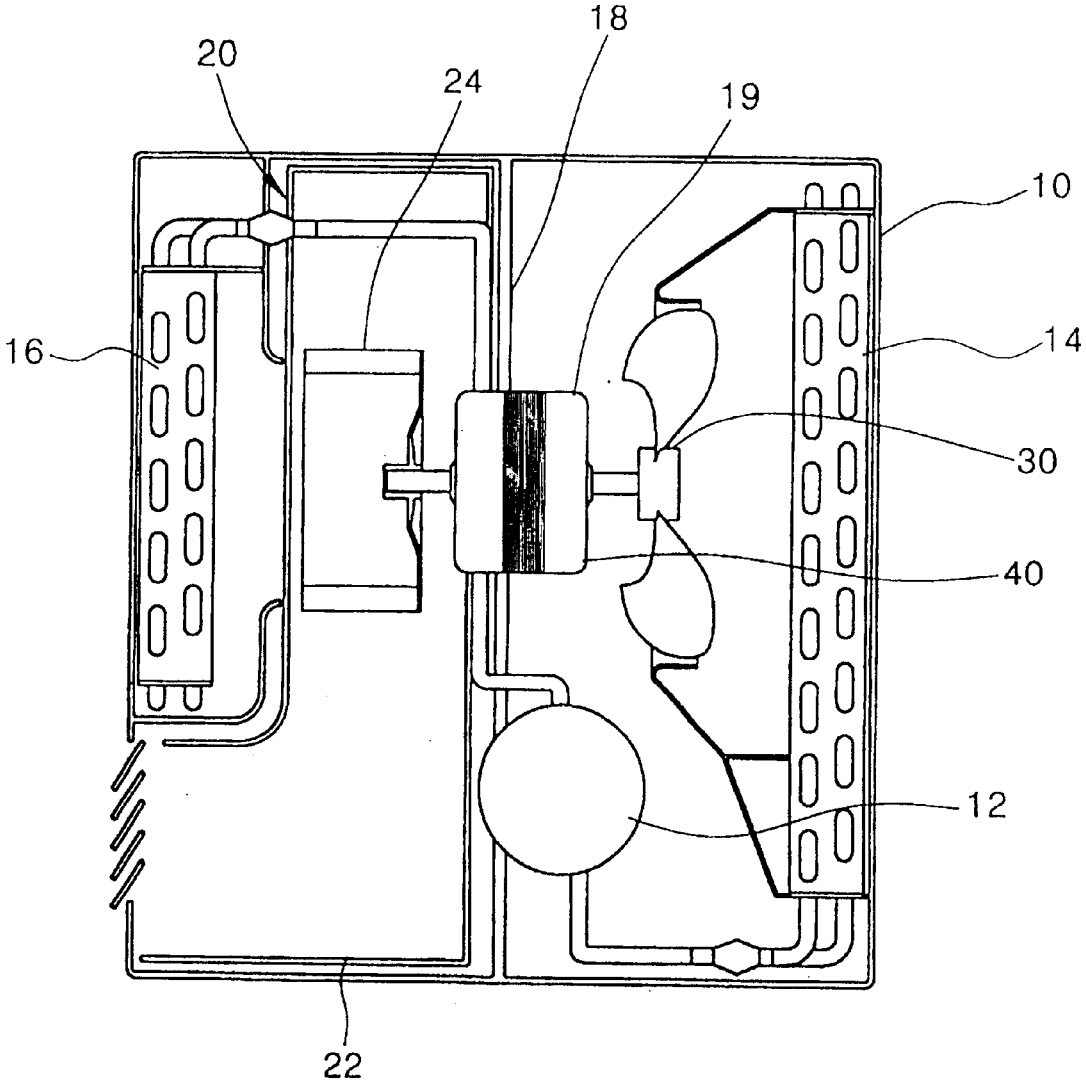
FIG. 1 is a schematic cross-sectional view illustrating the construction of a conventional window-type air conditioner.
Figure 2:
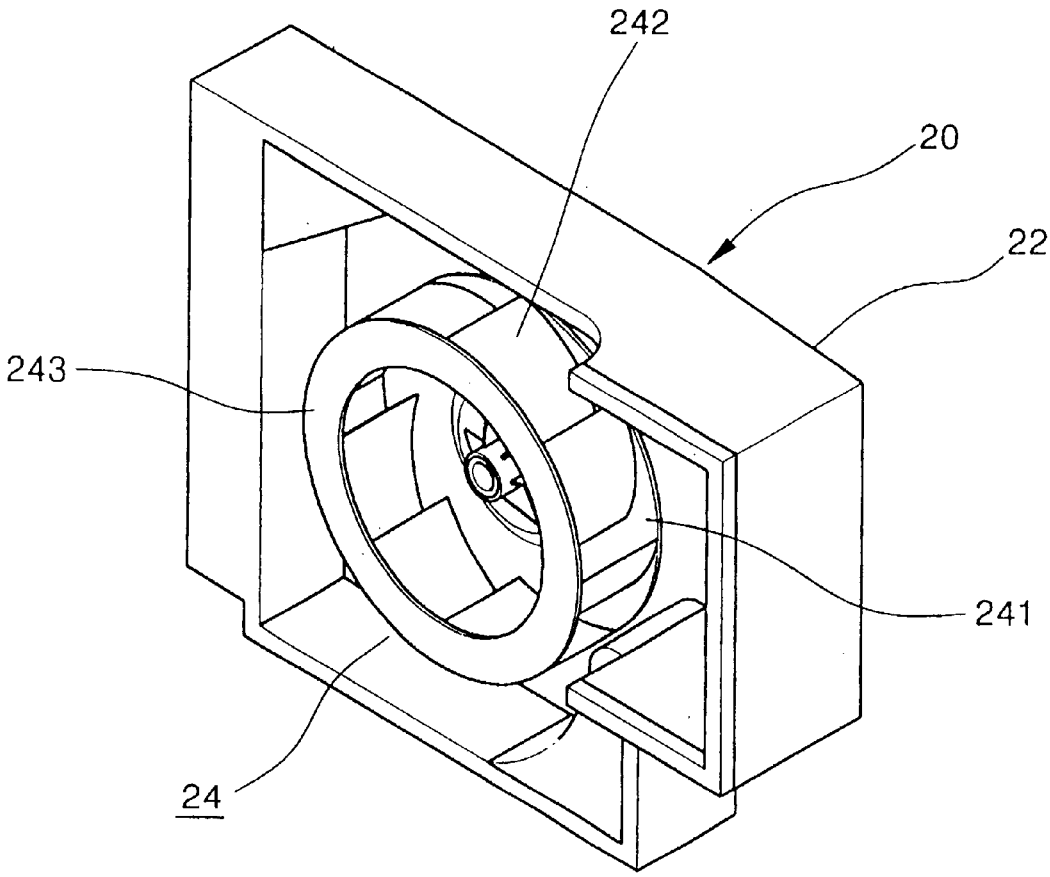
FIG. 2 is a perspective view illustrating the construction of a conventional blowing fan assembly which is applied to a conventional window-type air conditioner.

Reference will now be made in greater detail to a preferred embodiment of the invention, an example of which is illustrated in FIGS. 5 through 8. Wherever possible, the same reference numerals will be used throughout the drawings and the description to refer to the same or like parts.

Figure 5:
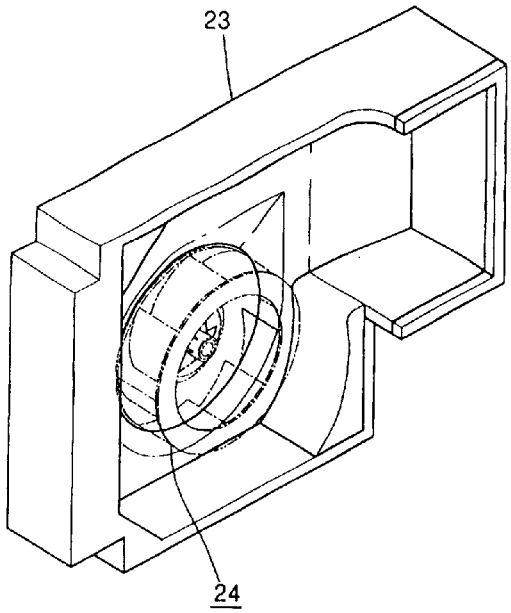
FIG. 5 is a front perspective view illustrating the construction of a blowing fan assembly in accordance with an embodiment of the present invention.

First, a blowing fan assembly for a window-type air conditioner, in accordance with an embodiment of the present invention, includes, as shown in FIG. 5, a scroll case 23, and a turbofan 24 which is disposed in the scroll case 23.

Figure 6:
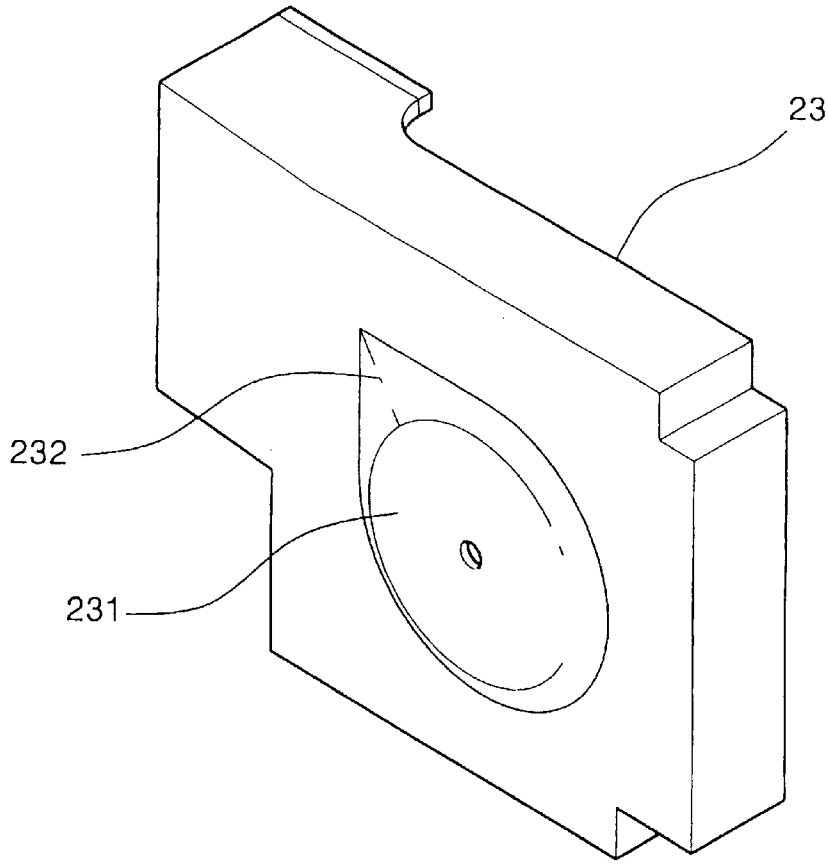
FIG. 6 is a rear perspective view illustrating the construction of the blowing fan assembly in accordance with the embodiment of the present invention.

As can be readily seen from FIG. 6, the scroll case 23 is configured in a manner such that a depression 231 is formed at a bottom wall thereof. The turbofan 24 is lop-sidedly positioned in the scroll case 23 in such a way as to adjoin the depression 231, whereby the distance between the shroud 243 of the turbofan 24 and the suction opening 23*a* of the scroll case 23 is lengthened (see FIG. 7).

Figure 7:
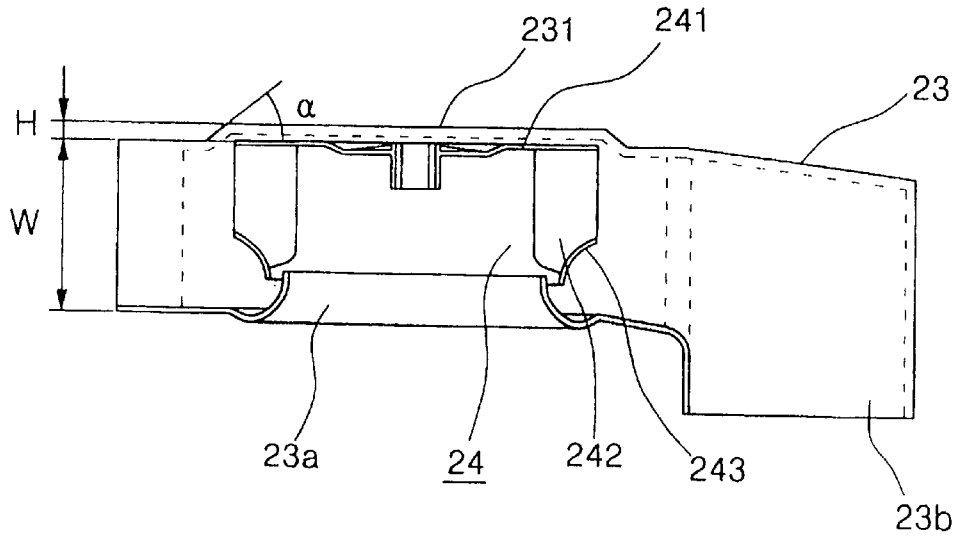
FIG. 7 is a transverse cross-sectional view of FIG. 5, illustrating the construction of the blowing fan assembly in accordance with the embodiment of the present invention.
Figure 8:
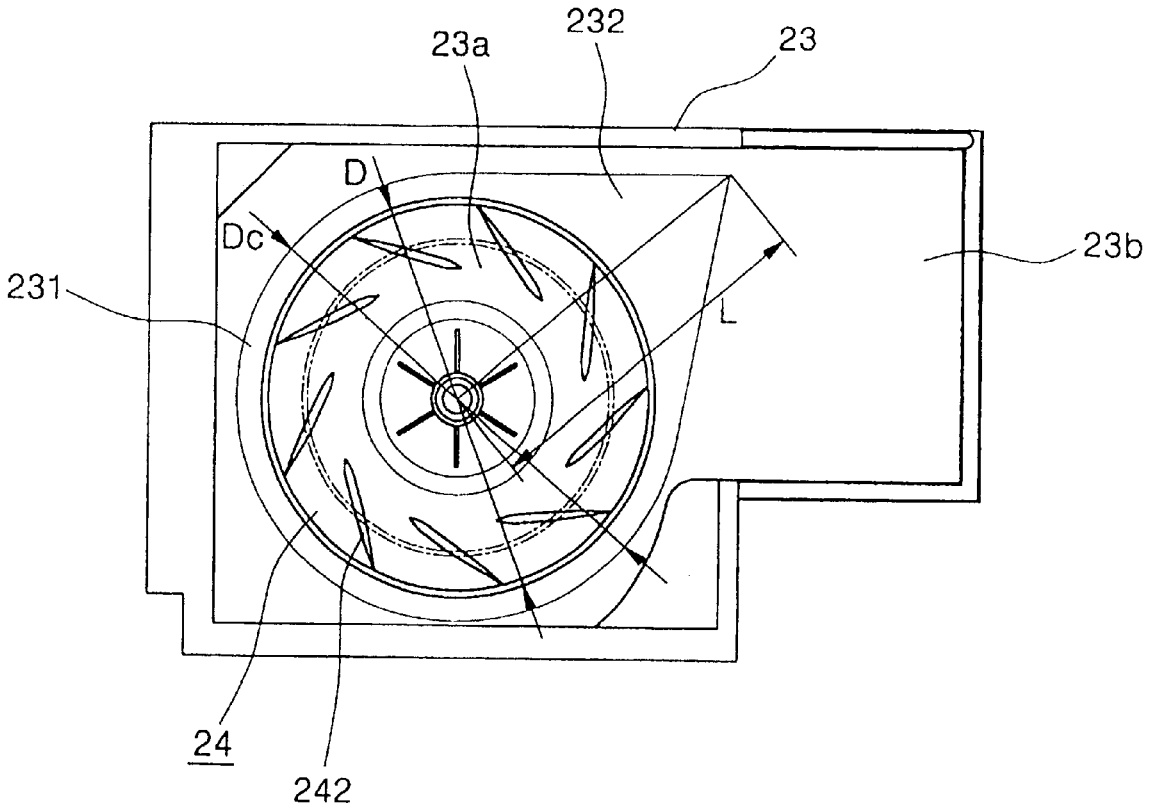
FIG. 8 is a longitudinal cross-sectional view of FIG. 5, illustrating the construction of the blowing fan assembly in accordance with the embodiment of the present invention.

Referring to FIGS. 7 and 8, the depression 231 is formed in a manner such that it has a depth H in the range of 10–20% of a width W of the scroll case 23, a diameter Dc in the range of 100–110% of an outer diameter D (of a circle which is obtained by connecting outer ends of the respective blades) of the turbofan 24, and a projecting angle $\alpha$ of 30–45°.

An auxiliary depression 232 is formed at a side of the depression 231 on the bottom wall of the scroll case 23. The auxiliary depression 232 communicates with the depression 231 so as to allow the flow rate of air discharged from the turbofan 24 to be increased.

The auxiliary depression 232 is gradually reduced in its depth and narrowed in its width in a direction which is remote from the depression 231, and has a wedge-shaped contour. The auxiliary depression 232 is formed in a manner such that the distance L between the apex thereof and the center of the depression 231 is in the range of 140–160% of the outer diameter D of the turbofan 24.

Figure 3:
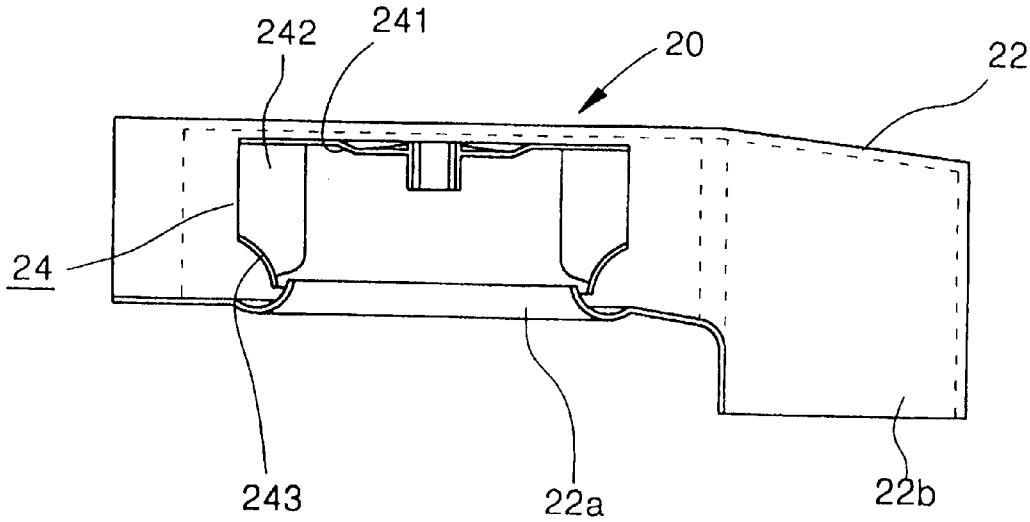
FIG. 3 is a transverse cross-sectional view of FIG. 2, illustrating the construction of a conventional blowing fan assembly.
Figure 4:
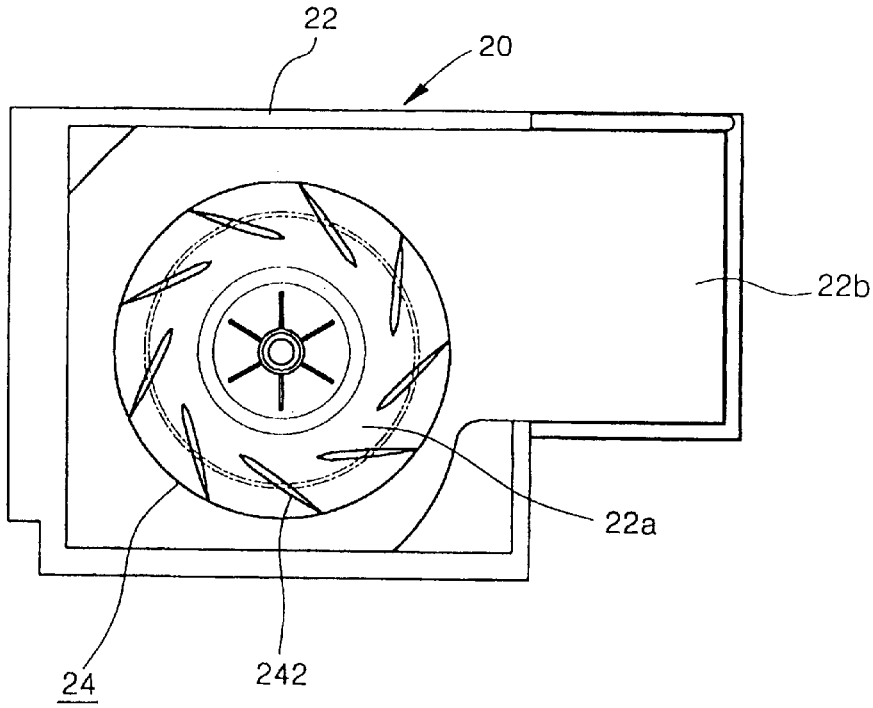
FIG. 4 is a longitudinal, cross-sectional view of FIG. 2, illustrating the construction of a conventional blowing fan assembly.

By the blowing fan assembly in accordance with the present invention, constructed as mentioned above, the entire size of the scroll case 23 is not enlarged when compared with the conventional scroll case 22 (see FIG. 3), but rather only the turbofan 24. is moved toward the rear end of the scroll case 23.

Consequently, as the distance between the shroud 243 of the turbofan 24 and the suction opening 23*a* of the scroll case 23 is enlarged, the air suction amount is increased.

Also, due to the presence of the auxiliary depression 232 which is formed at the side of the depression 231, because air flows in a smoother manner through the turbofan 24 toward a discharge opening 23*b* of the scroll case 23, the air discharge amount is also increased in response to the increased amount of air suction.

In other words, in the blowing fan assembly according to the present invention, since the same air blowing rate is maintained even when the rotational velocity of the turbofan 24 is decreased in comparison with the conventional blowing fan assembly, by decreasing the rotational velocity of the turbofan 24, it is possible to reduce the operating noise which is produced by the driving motor 40.

Thus, the blowing fan assembly according to the present invention provides the following advantages: First, by modifying the structure of the scroll case and changing the position of the turbofan, the air blowing rate is increased without experiencing an increase in the volume of the entire blowing fan assembly. Second, when assuming that the blowing fan assembly according to the present invention has the same air blowing rate as the conventional blowing fan assembly, the rotational velocity of the blowing fan assembly according to the present invention can be decreased, whereby operating noise produced by a driving motor is remarkably reduced.

In the drawings and specification, there have been disclosed typical preferred embodiments of the invention and, although specific terms are employed, they are used in a generic and descriptive sense only and not for purposes of limiting the scope of the invention as set forth in the following claims.

What is claimed is:

1. A blowing fan assembly for a window-type air conditioner containing a scroll case and a turbofan disposed in the scroll case and connected with a driving motor, the turbofan containing a hub, a plurality of blades which are located at a predetermined separation from the hub and a shroud which is attached to distal ends of the plurality of blades and opposite to the hub, wherein a depression is formed at the rear wall of the scroll case in a manner such that the diameter of the depression is greater than an outer diameter of the turbofan, and the turbofan is positioned in the scroll case in such a way as to adjoin the depression, whereby an air passage which is defined between the shroud of the turbofan and a suction opening of the scroll case, is enlarged.

2. The blowing fan assembly as claimed in claim 1, wherein an auxiliary depression which has a wedge-shaped configuration, is formed at a side of the depression on the rear wall of the scroll case, in a manner such that the auxiliary depression is gradually reduced in a direction remote from the depression so as to allow the flow rate of air discharged out of the turbofan to be increased.

3. The blowing fan assembly as claimed in claim 1, wherein the depression is formed in a manner such that it has a depth in the range of 10–20% of the width of the scroll case, a diameter in the range of 100–110% of an outer diameter of the turbofan, and a projecting angle of 30–45°.

4. The blowing fan assembly as claimed in claim 2, wherein the auxiliary depression, having a wedge-shaped contour, is formed in a manner such that the distance between the apex thereof and the center of the depression is in the range of 140–160% of the outer diameter of the turbofan.

* * * * *